United States Patent [19]
Blanco
[11] 4,242,810
[45] Jan. 6, 1981

[54] HAIR STYLING APPARATUS

[76] Inventor: David M. Blanco, 2408 Broadwater Ave., Billings, Mont. 59102

[21] Appl. No.: 42,074

[22] Filed: May 24, 1979

[51] Int. Cl.[3] ..... A45D 20/16
[52] U.S. Cl. ..... 34/98; 34/88; 248/124
[58] Field of Search ..... 248/124; 132/9; 34/97, 34/98, 99, 88, 222, 224, 225

[56] References Cited

U.S. PATENT DOCUMENTS

| | | | |
|---|---|---|---|
| 1,585,410 | 5/1926 | Olopson | 34/98 |
| 2,040,268 | 5/1936 | Orton | 34/98 |
| 2,048,143 | 7/1936 | Seidman et al. | 34/98 |
| 2,076,040 | 4/1937 | Norquist | 34/98 |
| 3,385,036 | 5/1968 | Webb | 248/124 |
| 3,713,453 | 1/1973 | Chiaro et al. | 132/9 |
| 3,787,986 | 1/1974 | Burger | 34/222 |
| 4,161,955 | 7/1979 | Webb | 132/9 |

FOREIGN PATENT DOCUMENTS

| | | | |
|---|---|---|---|
| 2360772 | 6/1975 | Fed. Rep. of Germany | 132/9 |

*Primary Examiner*—Larry I. Schwartz
*Attorney, Agent, or Firm*—Arthur L. Urban

[57] ABSTRACT

Hair styling apparatus including a cross frame member, support members extending upwardly from the cross frame member, a central power section associated with the cross frame member, light emitting members associated with the central power section, a plurality of rigid arm sections associated with the central power section, rigid cross arm members pivotally connected adjacent the free ends of the rigid arm sections, the pivotable connections between the rigid arm sections and the rigid cross arm members including mechanisms for adjusting the ease of movement between the respective sections, flexible conduit members extending from each of the cross arm members, electrical appliances disposed on the free ends of the flexible conduit members, the electrical appliances including light emitting members, hot air conveying members and the like.

9 Claims, 2 Drawing Figures

HAIR STYLING APPARATUS

Figure 1:
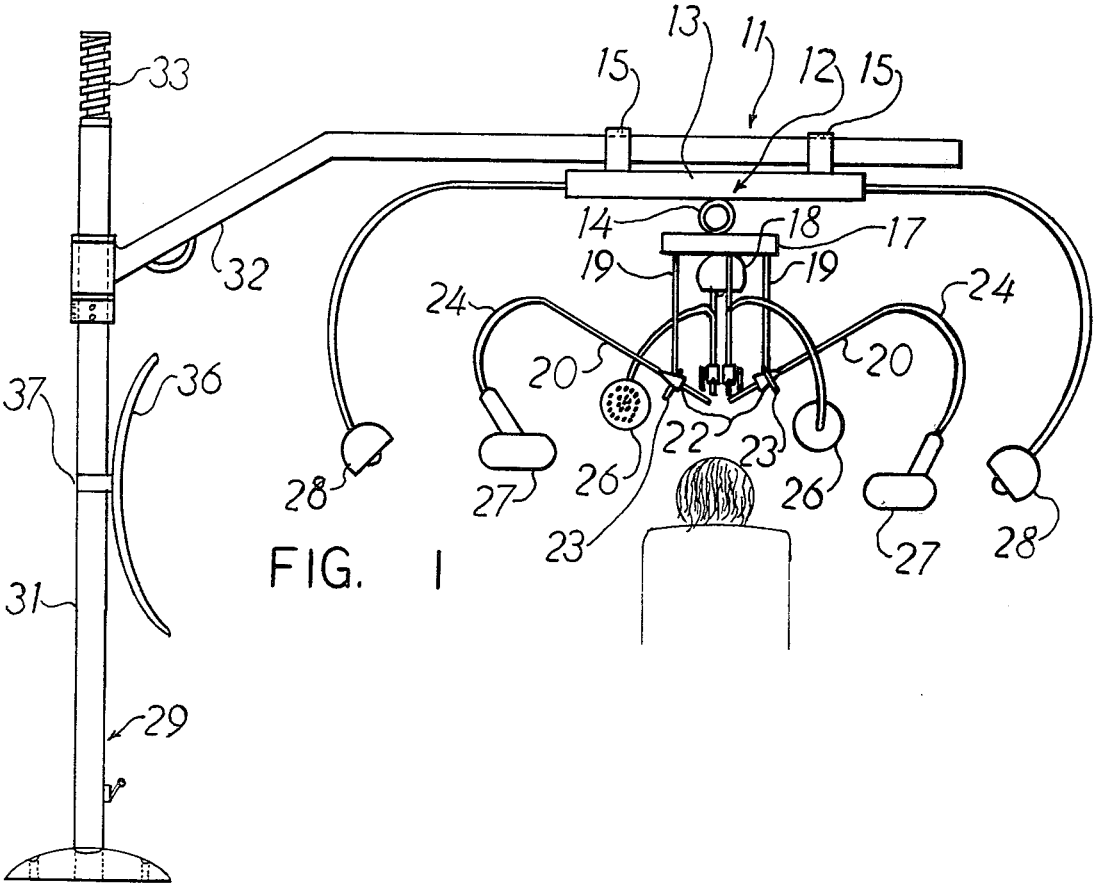

This invention relates to a novel hair styling apparatus and more particularly relates to a new apparatus which makes hair styling more convenient.

Throughout recorded history, individuals have been concerned about their appearances. One of the areas to which people direct their attention to improve their appearance is their hair. Good grooming includes frequently brushing, shampooing, curling or straightening, coloring and the like. These activities take a considerable period of time to perform.

As society has become more affluent, individuals have sought professional help in improving their appearance, and particularly the appearance of their hair. Hair stylists spend considerable time on each person to achieve the desired effect. Those stylists that please their customers develop a following of satisfied clientele and their services are in great demand.

In order for outstanding hair stylists to keep their customers happy and returning regularly for their services and consultations, they must provide the personal touches which the customer desires. Some stylists have a staff to assist them with more menial tasks so they can give at least a degree of personal attention to each of their customers. This increases the efficiency of the stylists so that they can satisfy a maximum of customers.

Another area of help for professional stylists is the wide variety of equipment and supplies which they have available for the styling of hair. Such equipment includes heating devices of different types, for example, blow dryers, etc. One of the problems with such equipment, however is how to handle the equipment and still work with the customer's hair since the dryers etc, are generally hand held. Several simple supports have been developed which either are clamped to the chair or an adjacent table or rest on the floor. While these supports are of some assistance they still do not provide an ideal solution to the problem since they create a great deal of clutter around the area in which the stylist is working.

The present invention provides a novel hair styling apparatus which makes it more convenient for hair stylists to do their work. The stylists using the hair styling apparatus of the invention can more easily provide the proper treatment or conditioning. In addition, the styling apparatus allows the stylist to have both hands free during his work. Furthermore, the styling apparatus facilitates the maintenance of a clutter-free atmosphere around the styling station. Also, the styling apparatus provides a high degree of flexibility in use so that the hair stylists have a great deal of control in providing individuality in their styling. The styling apparatus also can be easily adjusted by the stylist quickly and conveniently so that attention does not have to be diverted from the work at hand.

The hair styling apparatus of the invention is simple in design and relatively inexpensive to manufacture. The styling apparatus can be fabricated from commercially available components and materials using conventional metal fabrication techniques. In addition, the hair styling apparatus of the invention can be installed conveniently in only a few minutes with a minimum of instruction and without special skills or tools. Also, the styling apparatus is readily adaptable to existing facilities as well as new salons.

Figure 2:
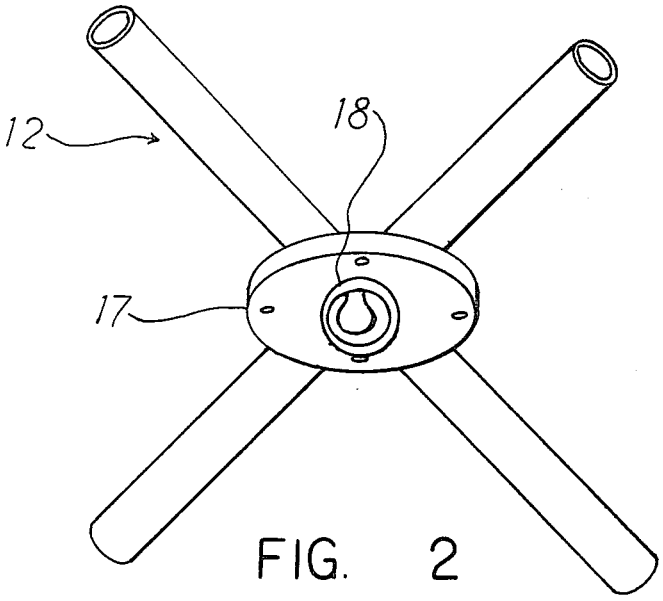

Other benefits and advantages of the novel hair styling apparatus of the invention will be apparent from the following description and accompanying drawings in which:

FIG. 1 is a schematic side elevation of one form of the hair styling apparatus of the invention; and FIG. 2 is a fragmentary view from below of the hair styling apparatus shown in FIG. 1.

As shown in the drawings one form of the novel hair styling apparatus 11 of the invention includes a cross frame member 12 having legs 13 and 14. Support means shown as adjustable brackets 15 extend upwardly from the cross frame member 12 along one of the legs thereof. The support means secure the cross frame member 12 to a main support member shown in the drawings as support 29 which will be described in detail hereinafter.

A central power section 17 is associated with the cross frame member 12. The central power section 17 provides a centralized source of electrical power for the apparatus of the invention. Light emitting means such as lamp 18 is associated with the central power section 17. Advantageously, the light emitting means is directed in a downward direction.

A plurality of rigid arm sections 19 are associated with a central power station 17. Rigid cross members 20 are pivotally connected adjacent the free ends of the rigid arm sections 19. The pivotal connections 22 between the rigid arm sections 19 and the cross arm sections 20 include means for adjusting the ease of movement between the respective sections. As shown in the drawings, the adjusting means include a handle 23 connected to a screw (not shown) which controls the tightness of the adjacent portions of the respective sections to one another.

Flexible conduit means 24 extends from each of the cross arm members 20. At the end of the flexible consuits 24 are disposed electrical appliances. The electrical appliances may include light emitting means, hot air conveying means and the like such as diffusors 26, blow dryers 27 and lamps 28.

The electrical appliances may be operative connected to the cross frame member 12 adjacent the central power section 17 or may be operatively connected to the cross frame member 12 adjacent the ends thereof. With the latter arrangement, some of the electrical appliances may be spaced a greater distance from the center of the apparatus as shown in the drawings to provide a unique arrangement thereof.

The main support member shown in the drawings as a support 29 for the cross frame member 12 and the associated appliances operatively connected therewith advantageously, includes a vertical section 31 extending upwardly from the base and a substantially horizontal section 32 extending to a point adjacent to the cross frame member. Also the main support member may include means for adjusting the height of the horizontal section 32 thereof. Such adjusting means shown as jack mechanism 33 provides changes in the height of the cross frame member 12 above the floor. The cross frame member 12 may be connected to a different support member such as an overhead rail or track (not shown).

If desired, the hair styling apparatus of the invention also may include other accessories. For example, as shown a mirror 36 may be mounted on the vertical section 31 of main support member 29 with brackets 37.

In use, a stylist moves the diffusors 26, blow dryers 27 and lamps 28 selectively into position around the head of the individual whose hair is being styled. This positioning of each electrical appliance can be performed very quickly without diverting the stylist's attention from his work. When the appliance has been properly positioned, which takes only an instant, the stylist has both hands free again to continue his work.

The above description and the accompanying drawings show that the present invention provides a novel hair styling apparatus which makes it more convenient for hair stylists to do their work. The styling apparatus of the invention allows a stylist to have both hands free while he is working. As a result, stylists using the hair styling apparatus of the invention can more easily provide the desired treatment or conditioning. The styling apparatus can be adjusted by the stylist easily and conveniently so that attention does not have to be diverted from the work at hand. Furthermore, the styling apparatus permits hair stylists to have a high degree of control of their work so they can provide individuality in their styling.

The hair styling apparatus of the invention is simple in design and relatively inexpensive to manufacture. The styling apparatus can be fabricated from commercially available components and materials. Moreover, the design of the hair styling apparatus facilitates installation in only a few minutes with a minimum of instruction and without special skills or tools, Also, the styling apparatus is readily adaptable to existing installations as well as new salons.

It will be apparent that various modifications can be made in the particular hair styling apparatus described in detail above and shown in the drawings within the scope of the invention. For example, the size and configuration of the components can be changed to meet specific requirements. Although it is desirable to fabricate the apparatus of one or more metals, other structural materials such as plastic, glass, wood and the like may be utilized if desired. In addition, the number and arrangement of the electrical appliances may be varied to meet specific needs. Therefore, the scope of the invention is to be limited only by the following claims:

What is claimed is:

1. Hair styling apparatus including a substantially horizontally disposed cross frame member, support means extending upwardly from said cross frame member engageable with a substantially horizontal support, a central power section attached to said cross frame member, light emitting means disposed below said central power section, a plurality of rigid arm sections extending from said cross frame member, rigid cross arm members pivotally connected adjacent the free ends of said rigid arm sections, said pivotable connections between said rigid arm sections and said rigid cross arm members including means for adjusting the ease of movement between respective sections, flexible conduit means extending from each of said cross arm members, electrical appliances disposed on the free ends of said flexible conduit means, said electrical appliances including light emitting means, hot air conveying means and the like.

2. Hair styling apparatus according to claim 1 including arm sections extending from the ends of said cross frame member.

3. Hair styling apparatus according to claim 1 including a main support member supporting said cross frame member.

4. Hair styling apparatus according to claim 1 wherein said support means includes encircling bracket means.

5. Hair styling apparatus according to claim 3 including a mirror mounted on said main support member.

6. Hair styling apparatus according to claim 3 wherein said main support member has a vertical section extending upwardly from a base surface and a substantially horizontal section extending adjacent said cross frame member.

7. Hair styling apparatus according to claim 1 wherein said light emitting means is directed in a downward direction.

8. Hair styling apparatus according to claim 3 wherein said main support member includes height adjusting means.

9. Hair styling apparatus according to claim 1 wherein said flexible conduit means extend from the free ends of said cross arm members.

* * * * *